United States Patent [19]

Spademan

[11] 4,338,735

[45] Jul. 13, 1982

[54] DYNAMIC INTERNAL FITTING SYSTEM FOR A SPORT SHOE

[76] Inventor: Richard G. Spademan, Box 6410, Incline Village, Nev. 89450

[21] Appl. No.: 274,031

[22] Filed: Jun. 15, 1981

Related U.S. Application Data

[63] Continuation of Ser. No. 104,283, Dec. 17, 1979, abandoned, which is a continuation-in-part of Ser. No. 50,436, Jun. 20, 1979, and a continuation-in-part of Ser. No. 886,946, Mar. 15, 1978.

[51] Int. Cl.[3] ..... A43B 5/04

[52] U.S. Cl. ..... 36/119

[58] Field of Search ..... 36/117, 118, 119, 120, 36/121

[56] References Cited

U.S. PATENT DOCUMENTS

| | | | |
|---|---|---|---|
| 3,374,561 | 3/1968 | Werner et al. | 36/119 |
| 3,883,964 | 5/1975 | Check | 36/119 |
| 4,160,332 | 7/1979 | Salomon | 36/119 |

*Primary Examiner*—Patrick D. Lawson

*Attorney, Agent, or Firm*—Townsend and Townsend

[57] ABSTRACT

A dynamic internal fitting system for a sport shoe (1) is described in which there is provided a foot-engaging means (5) for engaging a foot, a leg-engaging means (6) for engaging the leg to which the foot is attached, an assembly (7) for movably mounting the leg-engaging means (6) in said sport shoe (1) for movement of said leg-engaging means (6) and a coupling assembly (8) for coupling said leg-engaging means (6) and said foot-engaging means (5) for tightening and loosening the foot-engaging means (5) relative to said foot as said leg-engaging assembly (6) is moved.

13 Claims, 3 Drawing Figures

FIG. 1
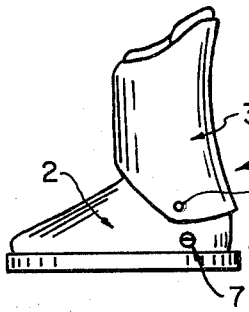
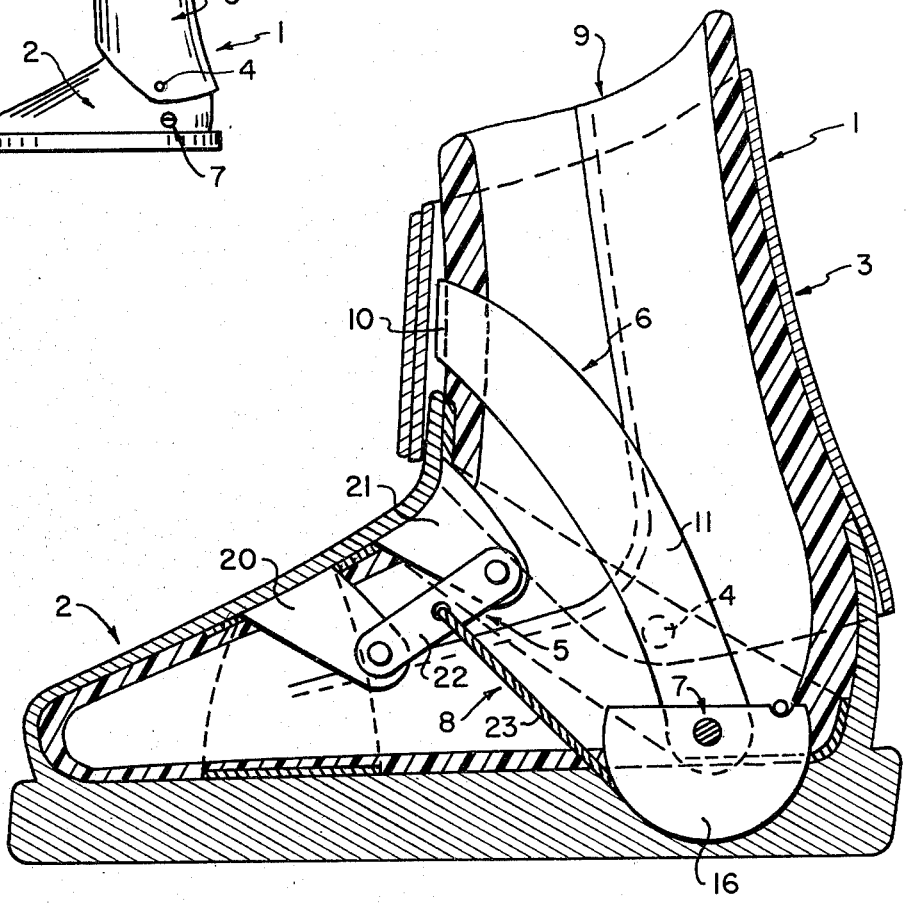
FIG. 2

DYNAMIC INTERNAL FITTING SYSTEM FOR A SPORT SHOE

RELATED APPLICATIONS

This is a continuation of application Ser. No. 104,283, filed Dec. 17, 1979, now abandoned, which is a continuation-in-part of applicant's U.S. Patent application Ser. No. 886,946 filed Mar. 15, 1978 and applicant's U.S. Patent application Ser. No. 50,436 filed June 20, 1979.

BACKGROUND OF THE INVENTION

The present invention relates to sport shoes in general and more specifically to a dynamic internal fitting system for a sport shoe as disclosed in applicant's above identified co-pending applications.

In application Ser. No. 886,946 there is disclosed a sport shoe in the nature of a ski boot. In the ski boot there is provided an upper cuff member and a lower rigid shell member. The upper cuff member is movably coupled to the lower shell member for forward and rearward movement in a plane parallel to the longitudinal axis of the boot. In the interior of the shell member there is provided a means for engaging the instep and forefoot of a skier's foot, such as, for example, a pair of strap members. The foot-engaging means is coupled to the movable cuff member by a cable coupled to a pulley which is in turn coupled to the cuff member.

In operation, as the cuff member is pivoted forwardly and rearwardly, tension is increased and decreased on the foot-engaging means relative to a foot engaged thereby.

In applicant's application Ser. No. 50,436 there is disclosed a movable foot bed located in the interior of a rigid shell of a ski boot. The foot bed is coupled to a movable cuff member.

In operation, as the movable cuff member moves forwardly and rearwardly in a plane parallel to the longitudinal axis of the ski boot, the movable foot bed is raised and lowered for adjusting the fit of the ski boot to a foot enclosed therein.

In both of the embodiments described a movable cuff member is employed for dynamically changing the fit of the sport shoe relative to a foot enclosed thereby.

Not all conventional ski boots are equipped with movable cuff members. In some cases the cuff member is rigidly attached to or formed as a rigid extension of a lower shell member. Turns and other forceful skiing maneuvers are accomplished by a skier leaning into the forward part of the cuff member. Ordinarily there is no movable part in the ski boot which moves significantly in response to the forward and rearward lean. To provide a dynamic fitting system which is responsive to leg movement in such a ski boot, it is necessary to provide in the fitting system means responsive to leg movement which is separate from the cuff member for dynamically adjusting the fit of the fitting system.

The need for a dynamic fitting system for dynamically changing the fit of the sport shoe is also desirable in sport shoes which are not provided with cuff members. For example, conventional sport shoes which do not ordinarily employ either movable or rigidly attached cuff members include such sport shoes as running and hockey shoes.

SUMMARY OF THE INVENTION

In view of the foregoing, a principal object of the present invention is a dynamic internal fitting system for a sport shoe for dynamically changing the fit of the sport shoe without requiring a cuff to open and close the mechanism.

Another object of the present invention is a sport shoe in which there is provided means for engaging a foot and means coupled to the foot-engaging means for adjusting the position of the foot-engaging means relative to a foot engaged thereby in response to movement of the leg to which the foot is attached.

Another object of the present invention is a sport shoe as described above in which there is provided a means for tightening the fit of the sport shoe in response to a forward movement of a leg relative to a foot attached thereto.

Another object of the present invention is a sport shoe as described above in which there is provided a rigid assembly including a rigid member which extends downwardly a predetermined distance from a location above the ankle to a position in the bottom of the sport shoe and means for coupling the rigid assembly to the foot-engaging means, said rigid assembly being movable in response to movement of a leg relative to a foot attached thereto.

By means of the present invention there is provided a dynamic internal fitting system for a sport shoe which may be used in sport shoes including boots with and without cuff members. This permits boots to be made with cuff members of varying styles and operation such as front and rear opening cuff members and cuff members with varying degrees of movement from rigid to extreme forward and rearward flex. Additionally, the invention may be used in sport shoes which do not normally have a cuff such as running and hockey shoes.

BRIEF DESCRIPTION OF THE DRAWING

The above and other objects, features and advantages of the present invention will become apparent from the following detailed description of the accompanying drawing in which:

FIG. 1 is a side elevation view of a sport shoe in the nature of a ski boot according to the present invention.

FIG. 2 is a side cross-sectional view of a sport shoe according to the present invention.

DETAILED DESCRIPTION OF THE DRAWING

Figure 3:
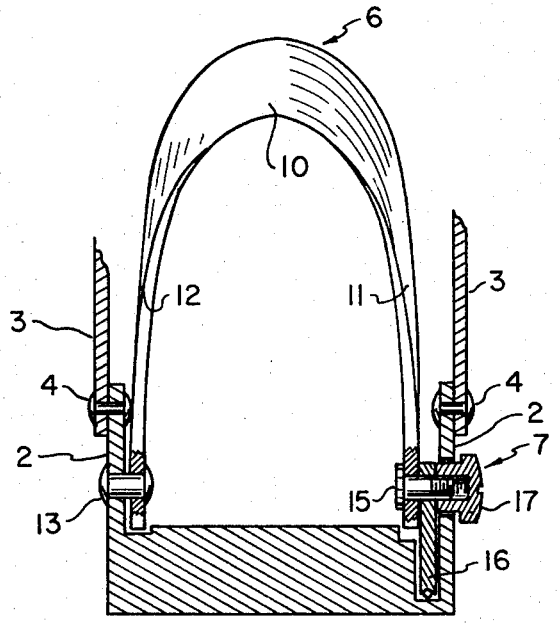
FIG. 3 is a front cross-sectional view of a flex bar according to the present invention.

Referring to FIGS. 1–3, there is provided in accordance with the present invention a sport shoe in the form of a ski boot designated generally as 1. In the sport shoe 1 there is provided a lower shell member 2 and a cuff member 3. The cuff member 3 is movably mounted to the shell member 2 as by a rivet pin 4. It should be understood, however, that the cuff member 3 could be rigidly attached in a non-movable manner to the lower shell 2 as the movement of the cuff 3 relative to the shell 2 forms no part of the present invention. Alternatively, the present invention, as will be seen, may be employed in a sport shoe without any cuff member at all.

Referring to FIGS. 2 and 3, there is provided in the interior of the sport shoe 1 a foot-engaging means designated generally as 5, a leg-engaging means designated generally as 6, means for movably mounting the leg-engaging means in the sport shoe designated generally as 7 and coupling means designated generally as 8 for coupling the leg-engaging means 6 and said foot-engaging means 5. For warmth and comfort there is provided in the interior of the boot 1 a liner designated generally as 9, typically fabricated from relatively soft, pliable rubber-like material.

In the leg-engaging means 6 there is provided a curved, generally rectangularly shaped section forming a shin-engaging means 10. Extending from the ends of the shin-engaging means 10 there is provided a pair of rigid arm members 11 and 12.

At the bottom of the members 11 and 12, the leg-engaging means 6 is movably mounted to the sport shoe 1 by means of the movable mounting means 7 and a corresponding mounting means in the form of a rivet or the like 13.

In the mounting means 7 there is provided a threaded stud 15, a pulley member 16 and an adjusting knob 17. The adjusting knob 17 and the stud 15 are provided for attaching the pulley member 16 to the bottom of the arm 11 in a friction-tight manner.

In the foot-engaging means 5 there is provided a pair of strap members 20 and 21. One end of the strap member 20 is attached to the foot bed of the sport shoe 1 in the ball of the foot area. The corresponding end of the strap member 21 is attached to the foot bed of the sport shoe 1 in the heel area. Both of the strap members 20 and 21 extend from their point of attachment to the foot bed of the shoe 1 over the instep portion of a foot to a linking member 22. The opposite ends of the strap members 20 and 21 are movably connected to opposite ends of the linking member 22. Between the strap members 20 and 21 the linking member 22 is attached to the pulley member 16 by a cable means 23.

In operation, during forward leaning of a leg relative to a foot enclosed by the foot-engaging means 5, the leg-engaging means 6 is moved forwardly about the axis of the mounting means 7. As the leg-engaging means 6 is moved about the axis of the mounting means 7, the pulley 16 is rotated in a counter-clockwise direction placing a tension on the cable means 23 and pulling on the straps 20 and 21. As the straps 20 and 21 are pulled, the fit of the leg-engaging means 5 is tightened relative to a foot engaged thereby. During rearward lean or when a skier is standing in a generally upright manner, the resistance of a foot engaged by the foot-engaging means 5 will cause the leg-engaging means 6 to move clockwise, as seen in FIG. 2, loosening the fit of the foot-engaging means.

To adjust the initial position of the leg-engaging means 6 relative to the pulley 16, the adjusting knob 17 in the mounting means 7 is loosened and the arms 11 and 12 moved in a clockwise or counter-clockwise direction as desired. After the leg-engaging means 6 is placed in the desired position, the knob member 17 is tightened, securing the position of the leg-engaging means 6 with respect to the pulley member 16.

While an embodiment of the present invention is shown and described, it is contemplated that various modifications to the embodiment described may be made without departing from the spirit and scope of the present invention. For example, in place of the rigid arms 11 and 12 and the rigid shin member 10 of the leg-engaging means 6, there may be used a variety of other means coupled to the foot-engaging means 5 for tightening and loosening the foot-engaging means 5 relative to a foot engaged thereby.

Instead of extending upwardly and forwardly to engage the shin of a leg, the arms 11 and 12 and the member 10 may be formed for engaging the calf of a leg with a strap or the like provided for removably attaching the member 10 to the leg's calf. In still other embodiments of the invention, strap means attached to a leg may, by cable and suitable pulley means attached to the front and rear margins of the cuff of a sport shoe, be coupled to the pulley 16 for moving the pulley 16 and consequently the foot-engaging means 5 as a leg is moved fore and aft relative to a foot attached thereby.

In each of the embodiments described and in the suggested modifications thereto the means for moving the foot-engaging means 5 is independent of any existing cuff member such as the cuff member 3 and may be employed in a sport shoe without any cuff member. Accordingly it is intended that the embodiments described and the suggested modifications thereto be employed solely for purposes of illustrating the present invention and that the scope of the present invention be determined solely by reference to the claims hereinafter provided and their equivalents.

What is claimed is:

1. A sport shoe comprising:

a foot-engaging means for engaging a foot;

a leg-engaging means separate from said sport shoe for engaging the leg to which said foot is attached, said leg-engaging means extending from a first point above the ankle of said foot to a second point;

means for movably mounting said leg-engaging means in said sport shoe for movement of said leg-engaging means relative to said second point in response to a movement of said leg relative to said foot; and means coupling said leg-engaging means and said foot-engaging means for tightening and loosening said foot-engaging means relative to said foot as said leg-engaging means is moved.

2. A sport shoe according to claim 1 wherein said leg-engaging means comprises means for engaging the shin of said leg and means forming a rigid connecting means extending from said shin-engaging means to said second point.

3. A sport shoe according to claim 2 wherein said shin-engaging means comprises a curved, generally rectangular member and said rigid connecting means comprises a pair of rigid connecting members extending from opposite ends of said curved, generally rectangular member.

4. A sport shoe according to claim 1 wherein said leg-engaging means comprises a shin-engaging member and means forming an arm member for supporting said shin-engaging member, and said means for movably mounting said leg-engaging means in said sport shoe comprises means for movably mounting the lower end of said arm member to said sport shoe at said second point.

5. A sport shoe according to claim 4 wherein said mounting means comprises a pulley means and said means for coupling said foot and leg-engaging means comprises cable means for coupling said foot-engaging means and said pulley means.

6. A sport shoe according to claim 5 wherein said foot-engaging means comprises a pair of strap members; and means for attaching one end of said strap member to the foot bed of said sport shoe in the heel and ball-of-the-foot sections thereof and the opposite ends of said strap members to said cable means.

7. A sport shoe according to claim 6 wherein said strap member attaching means comprises a linking member, means for attaching one end of each of said strap members to opposite ends of said linking member and means for attaching said cable means to said linking member between said strap members.

8. A sport shoe comprising:

a shoe body for receiving a foot;

foot engaging means disposed within the body for snugly engaging the foot;

leg engaging means mounted to the body for movement relative thereto in first and second directions and for engaging the leg to which the foot is attached; and means coupling the leg engaging means and the foot engaging means so that the relative snugness of the foot engaging means on the foot is increased when the leg engaging means is moved in the first direction and is decreased when the leg engaging means is moved in the second direction.

9. A sport shoe according to claim 8 wherein the leg engaging means is at least partially disposed within the body.

10. A sport shoe according to claim 8 including means for pivotally mounting the leg engaging means to the body.

11. A sport shoe according to claim 9 wherein the body comprises a shell including a shoe sole.

12. A sport shoe according to claim 10 wherein the body further comprises a cuff member attached to the shell and extending from the shell generally upwardly so as to extend over a portion of the leg.

13. A sport shoe according to claim 12 including means for pivotally attaching the cuff member to the shell to permit relative pivotal movements between the cuff member and the shell.

* * * * *